US005850740A

United States Patent [19]

Sato et al.

[11] Patent Number: 5,850,740

[45] Date of Patent: Dec. 22, 1998

[54] FLUIDIZED BED POWER PLANT, AND CONTROL APPARATUS AND METHOD THEREOF

[75] Inventors: Yoshio Sato; Masahide Nomura, both of Hitachi; Yasunori Yamamoto, Kure; Eiji Toyama, Toukai-mura, all of Japan

[73] Assignees: Hitachi, Ltd.; Babcock-Hitachi Kabushiki Kaishia, both of Tokyo, Japan

[21] Appl. No.: 582,360

[22] Filed: Jan. 5, 1996

[30] Foreign Application Priority Data

Jan. 20, 1995 [JP] Japan ..... 7-006926

[51] Int. Cl.[6] ..... F01K 13/00

[52] U.S. Cl. ..... 60/676; 110/101 CA; 110/101 CD

[58] Field of Search ..... 110/101 CA, 101 CD, 110/186; 122/449; 60/676

[56] References Cited

U.S. PATENT DOCUMENTS

| | | | |
|---|---|---|---|
| 4,085,593 | 4/1978 | Larsen | 60/676 |
| 4,499,857 | 2/1985 | Wormser | 110/186 |
| 4,779,574 | 10/1988 | Nilsson et al. | 122/4 D |
| 4,800,846 | 1/1989 | Idei et al. | 122/449 |

*Primary Examiner*—Noah P. Kamen

*Attorney, Agent, or Firm*—Antonelli, Terry, Stout & Kraus, LLP

[57] ABSTRACT

A power plant has two fluidized beds, one of the fluidized beds being used for generating main steam and the other being used for generating reheated steam. Further, the power plant includes a control apparatus for controlling the main steam by adjusting the fuel flow for the main steam generating fluidized bed and the fuel flow for the reheated steam generating fluidized bed so that each of the main steam temperature and the reheated temperature is maintained at a respective predetermined value.

6 Claims, 12 Drawing Sheets

FLUIDIZED BED POWER PLANT, AND CONTROL APPARATUS AND METHOD THEREOF

BACKGROUND OF THE INVENTION

The present invention relates to a fluidized bed power plant including fluidized bed boilers in which fuel, such as coal, mixed with a fluidized bed medium, such as limestone, is burned, and a control apparatus and a control method for use therein. The invention relates especially to a fluidized bed power plant including a fluidized bed boiler for generating main steam and another fluidized bed boiler for generating reheated steam, and a control apparatus and a control method for use therein.

In an existing pressurized fluidized bed power plant, a heat-exchanger for generating main steam and a heat-exchanger for generating reheated steam are contained in a fluidized bed boiler. And, in the boiler, a fuel, such as coal, is mixed with a fluidized bed medium, such as limestone, and the mixture forms the fluidized bed and is burned to generate steam via heat-exchange.

In such a power plant, the temperature of the fluidized bed is preferably kept at about 800° C.–900° C. from the point of view of the desulfurization performance and the prevention of ash fusion. And, the load for the plant is generally controlled by adjustment of the fluidized bed temperature and the contact area (heat transfer area) of the heat-exchangers and the fluidized bed by changing the fluidized bed height and by controlling the fuel flow for the boiler. Further, the temperature of the main steam and the reheated steam is controlled by changing the spray flow at an exit of each one of the heat-exchangers, respectively.

A power plant system in which a fluidized bed boiler, containing a heat-exchanger for generating main gas and a fluidized bed boiler containing a heat-exchanger for generating the reheated gas, are separately installed and the amount of gas generated by each boiler is controlled by adjusting the bed height of each boiler, is disclosed, for example, in JP-A-248801/1993.

In the existing method of controlling the steam temperature by changing the height of the fluidized bed, the height of the fluidized bed is controlled by feeding fluidized bed medium of 150° C.–200° C. into the bed of 800° C.–900° C., or by taking out the mixed material of the bed from the fluidized bed. Then, in changing the bed height, the temperature of the bed rapidly changes, and it takes a long time for the steam temperature to reach the required temperature. Especially, in the case of increasing the bed height, since the bed temperature rapidly decreases for a period, it probably causes a deterioration of the plant efficiency and the desulfurization performance. Further, the change of the steam temperature due to a rapid change of the bed temperature also probably exceeds the allowed temperature deviation of the steam turbine to a large extent, and it does not provide good effects for safe operation of the steam turbine.

As mentioned above, the conventional method of controlling the steam temperature by changing the bed height makes it difficult for the steam temperature to quickly follow load changes, and so this is not necessarily a good method from the point of view of the plant efficiency and plant safety.

SUMMARY OF THE INVENTION

The present invention has been developed in consideration of the above described problems, and firstly aims at providing a fluidized bed power plant which is capable of improving the load following performance and the plant efficiency by using at least two fluidized bed boilers for respectively generating main steam and reheated steam, the temperature of each of the main steam and the reheated steam being controlled by changing the fuel flow for each one of the boilers.

A second object of the present invention is to provide a control apparatus for a fluidized bed power plant, which can change the bed height so that the temperature of the main steam and the bed does not rapidly change.

A fluidized bed power plant according to the present invention, to attain the first object, comprises a first fluidized bed boiler for generating steam; a first steam turbine driven by the steam generated by the first fluidized bed boiler; a second fluidized bed boiler for heating the steam which has driven the first steam turbine; and a second steam turbine driven by the steam heated by the second fluidized bed boiler.

A fluidized bed power plant according to the present invention, to attain the first object, comprises a first fluidized bed boiler for generating steam; a first steam turbine driven by the steam generated by the first fluidized bed boiler; a second fluidized bed boiler for heating the steam which has driven the first steam turbine; and a second steam turbine driven by the steam heated by the second fluidized bed boiler; wherein the fuel flow for the first fluidized bed boiler is controlled based on the temperature of the steam generated by the first fluidized bed boiler, and the fuel flow for the second fluidized bed boiler is controlled based on the temperature of the steam heated by the second fluidized bed boiler.

The means for controlling the fuel flow for the fluidized bed boilers based on the steam temperature comprises a first fuel feeding means for feeding fuel to the first fluidized bed boiler; a second fuel feeding means for feeding fuel to the second fluidized bed boiler; a first steam temperature controlling means for controlling the temperature of the steam generated by the first fluidized bed boiler by controlling the flow of fuel fed by the first fuel feeding means based on the detected temperature of the steam generated by the first fluidized bed boiler; and a second steam temperature controlling means for controlling the temperature of the steam generated by the second fluidized bed boiler by controlling the flow of fuel fed by the second fuel feeding means based on the detected temperature of the steam generated by the second fluidized bed boiler.

Then, the second steam turbine is driven by the steam of lower pressure than the first steam turbine, and the rotating axis of the second steam turbine is connected to the rotating axis of the first steam turbine.

A fluidized bed power plant according to the present invention, to attain the first object, comprises a first fluidized bed boiler for generating steam; a first steam turbine driven by the steam generated by the first fluidized bed boiler; a second fluidized bed boiler for heating the steam which has driven the first steam turbine; a second steam turbine driven by the steam heated by the second fluidized bed boiler; a first fuel feeding means for feeding fuel to the first fluidized bed boiler; a second fuel feeding means for feeding fuel to the second bed boiler; a first steam temperature controlling means for controlling the temperature of the steam generated by the first fluidized bed boiler by controlling the flow of fuel fed by the first fuel feeding means based on the detected temperature of the steam generated by the first fluidized bed boiler; and a second steam temperature controlling means for controlling the temperature of the steam generated by the second fluidized bed boiler by controlling the flow of fuel fed by the second fuel feeding means based on the detected temperature of the steam generated by the second fluidized bed boiler.

Further, a control method for controlling a fluidized bed power plant according to the present invention, to attain the first object, comprises the steps of controlling the temperature of main steam for driving a high pressure turbine by controlling the flow of fuel fed to a first fluidized bed boiler based on the detected temperature of the main steam generated by the first fluidized bed boiler; and controlling the temperature of reheated steam, obtained by heating the steam having driven the high pressure turbine, for driving a low pressure turbine by controlling the flow of fuel fed to a second fluidized bed boiler based on the detected temperature of the reheated steam.

A control apparatus for a fluidized bed power plant according to the present invention to attain the second object, includes at least one fluidized bed boiler in which fuel mixed with a fluidized medium forms a fluidized bed and is burned, and bed height control means for controlling the height of the bed in the fluidized bed boiler by feeding the fluidized bed medium into the fluidized bed boiler or taking out a part of the bed of the fluidized bed boiler. The control apparatus comprises temperature deviation calculating means for obtaining the temperature deviation of the detected temperature of the bed from the set temperature; bed height setting value calculating means for obtaining a bed height setting value from the load demand command for the power plant; means for obtaining a control signal based on the deviation of the detected bed height from the bed height setting value obtained by the bed height setting value calculating means and for sending said control signal to said bed height control means; and means for keeping the bed height setting value obtained by the bed height setting value calculating means to a fixed value in case the temperature deviation obtained by the temperature deviation calculating means exceeds a predetermined value.

In accordance with the present invention, since the steam fed to the first steam turbine and the steam fed to the second steam turbine, driven by the steam obtained by heating the steam which has driven the first steam turbine, are generated by two independent fluidized boilers, respectively, and since each steam temperature is controlled by controlling the fuel flow fed to each one of the boilers, it is possible to control separately and adequately both the temperature of the steam for driving the first steam turbine (for example, a high pressure turbine) and the temperature of the steam for driving the second steam turbine (for example, a low pressure turbine), which can improve the load following characteristics of the steam temperature control.

Further, according to the present invention, since the bed height setting value is kept to a fixed value in case the temperature deviation of the detected bed temperature from the set value in applying feed-back control to the bed height exceeds a predetermined value, it is possible to control the bed height without rapidly changing the steam temperature. The reason why such a control is executed for controlling the bed height is explained in the following. For example, in the case of increasing the bed height, the bed height is increased by feeding the fluidized medium to the fluidized bed boiler. Then, the temperature of the bed rapidly decreases when increasing the bed height and the bed temperature can not be kept within the predetermined temperature range, since the difference between the bed temperature and the fluidized bed medium temperature is large. If the bed height setting value is increased in such a situation, then the bed temperature further decreases, since the fed amount of the fluidized bed medium will increase further. Therefore, as mentioned above, since the amount of the fluidized bed medium being fed is decreased before the bed temperature largely exceeds a predetermined range by keeping the bed height setting value to a fixed value if the deviation of the detected bed temperature from the set value exceeds a predetermined value, the decreasing extent of the bed temperature can be reduced even when increasing the bed height.

DETAILED DESCRIPTION OF THE EMBODIMENTS

Figure 1:
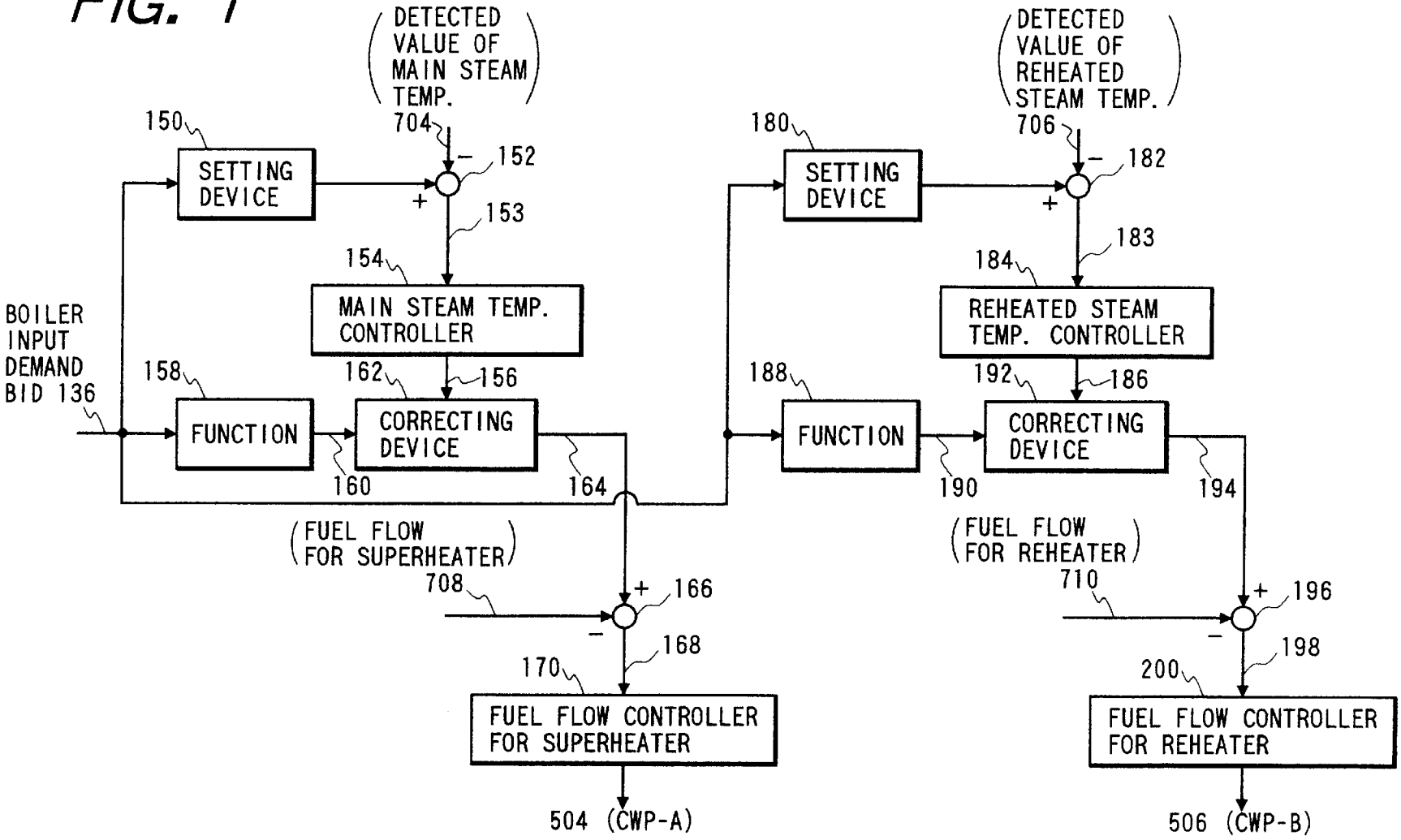
FIG. 1 is a schematic diagram of an embodiment of a control apparatus for a fluidized bed power plant according to the present invention.

Hereinafter, details of the present invention will be explained based on various embodiments while referring to the drawings.

Figure 12:
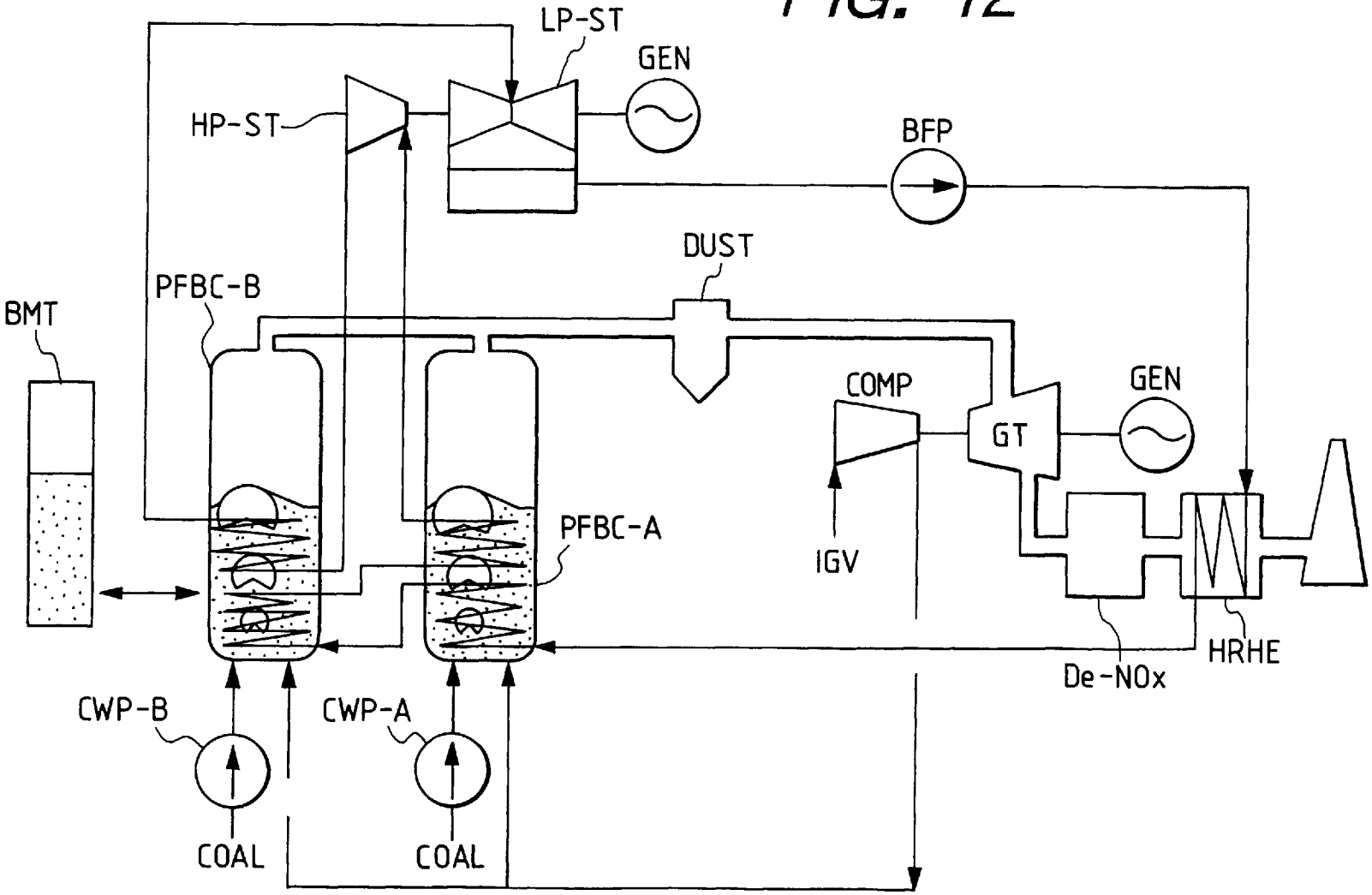
FIG. 12 is a diagram of the whole system constitution of the fluidized bed power plant of the present invention.

FIG. 12 shows the overall system constitution of a fluidized bed power plant of the present invention.

The fluidized bed power plant is characterized in that the power plant includes at least two sets of fluidized bed boilers PFBC-A and PFBC-B, and fuel feeding pumps CWP-A and CWP-B.

In the fluidized bed boilers PFBC-A and PFBC-B, coal fed from the fuel feeding pumps CWP-A and CWP-B, air sent from a gas-turbine compressor COMP via an inlet guide vane IGV and fluidized bed material fed from a bed material medium storage tank BMT are mixed and the fed coal is burned in the fluidized state. The burned gas in the fluidized bed boilers is processed to provide clean gas by a dust collection apparatus DUST and is supplied to a gas-turbine GT. The energy of the supplied gas is converted to rotation energy at the gas-turbine GT, and generates electric energy at a generator GEN. After working the gas-turbine, the gas is treated as exhaust gas, and ejected from a stack to the atmosphere, via a denitration apparatus De-NOx and an exhaust heat recovery heat-exchanger HRHE. As to feed water pressurized by a feed water pump BFP, the feed water absorbs heat at the HRHE, is superheated to a predetermined temperature by the fluidized bed boiler PFBC-A operating as an evaporator or a superheater and is supplied to a high pressure steam turbine HP-ST. After working the high pressure steam turbine HP-ST, the heated steam is reheated by the fluidized bed boiler PFBC-B operating as a reheater and is sent to a low pressure steam turbine LP-ST. Then, the energy of the steam is converted to rotation energy at the steam turbine, and generates electric energy at the generator GEN. The high pressure steam turbine HP-ST and the low pressure turbine LP-ST may possibly be engaged with the same rotating axis, i.e. may drive a common generator.

The bed height (fluidized bed height) of each one of the fluidized bed boilers PFBC-A and PFBC-B is increased by feeding the bed medium to the corresponding fluidized bed boiler from the fluidized bed medium storage tank BMT, and, on the contrary, is decreased by taking out a part of the bed material into the fluidized bed medium storage tank BMT.

FIG. 1 shows an embodiment of a control apparatus for a fluidized bed power plant of the present invention.

Figure 8:
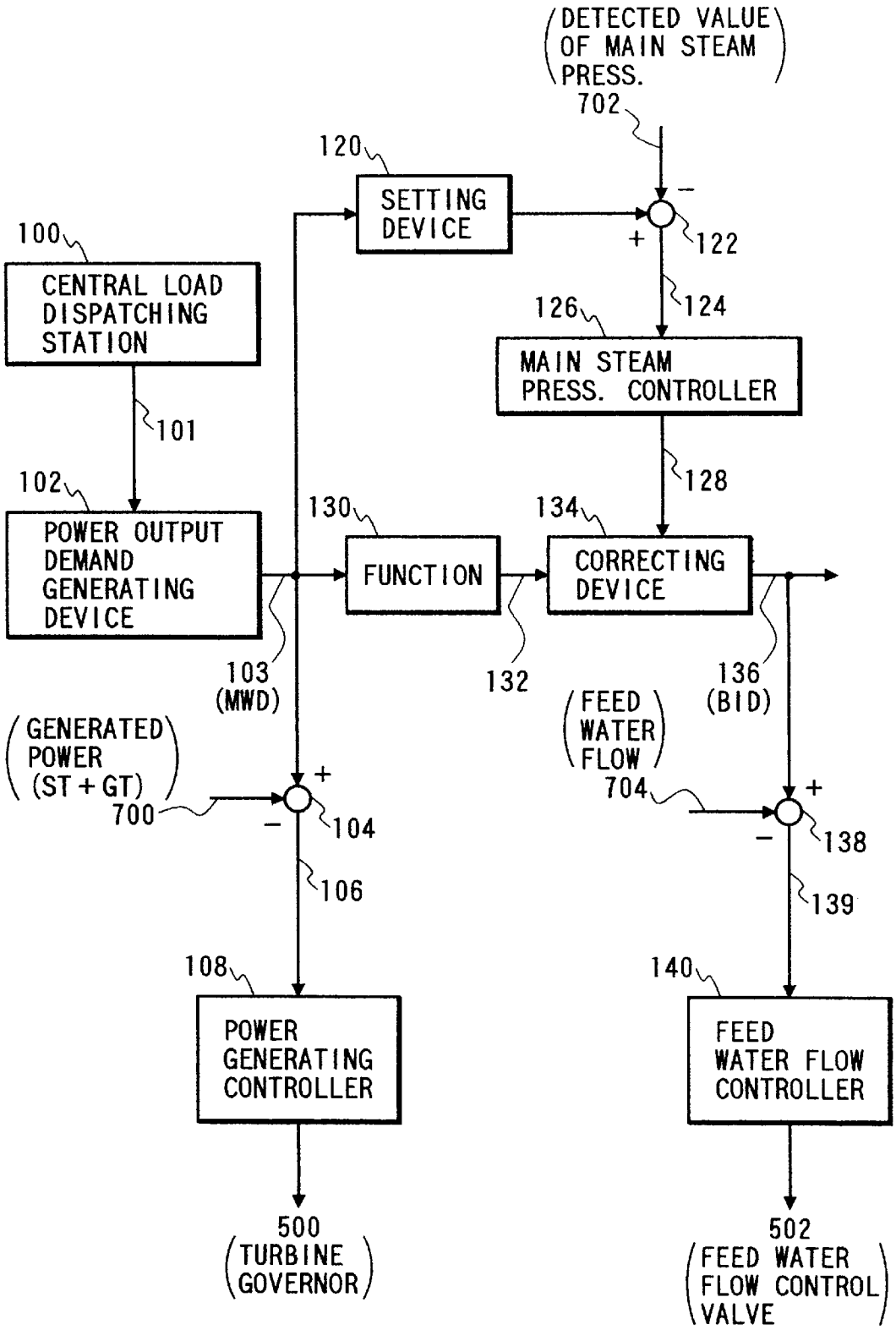
FIG. 8 is a schematic diagram of another embodiment of a control apparatus for a power plant, which is a boiler following type control apparatus for controlling generated power and main steam pressure.
Figure 9:
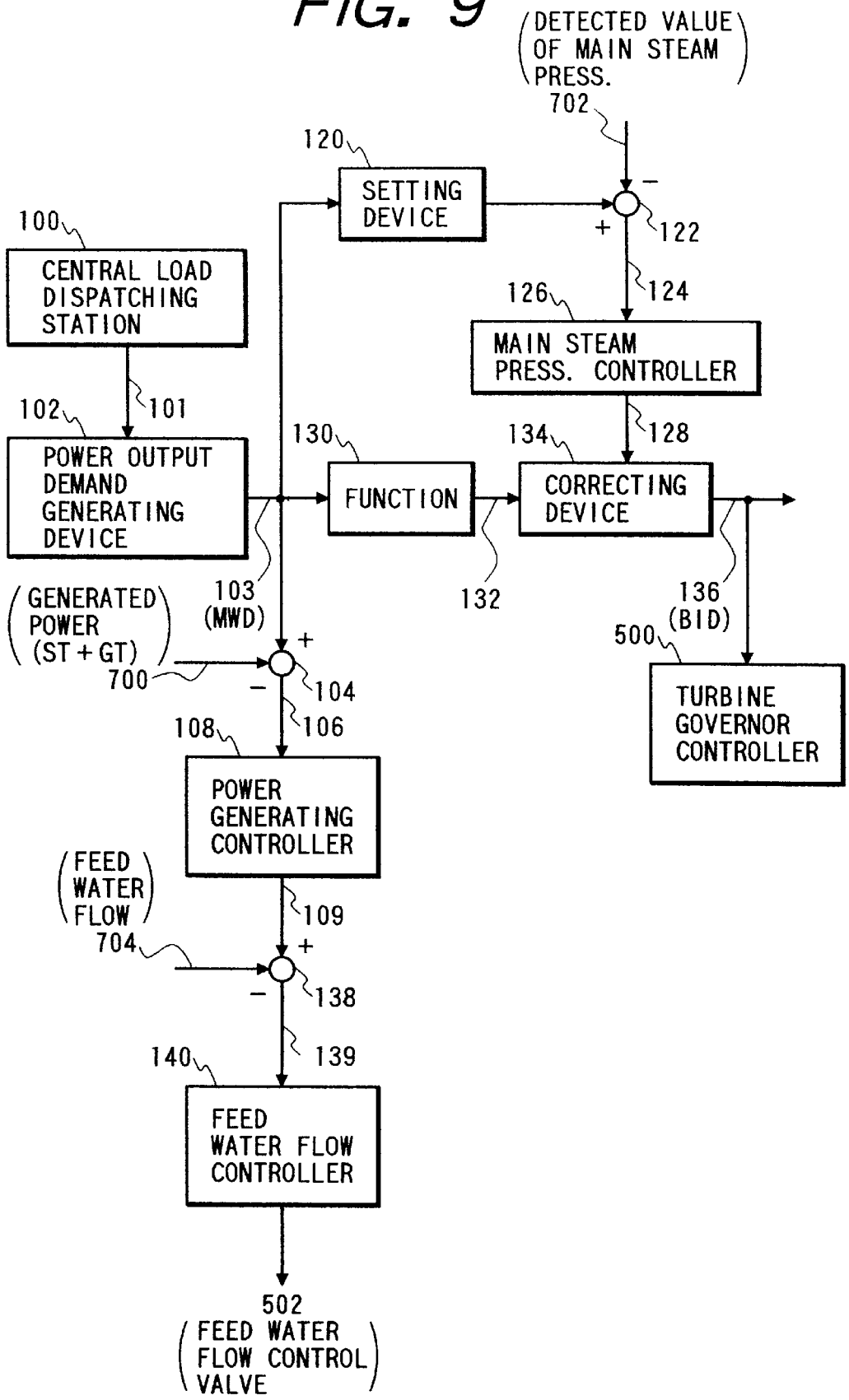
FIG. 9 is a schematic diagram of another embodiment of a control apparatus for a power plant, which is a turbine following type control apparatus for controlling generated power and main steam pressure.

In the figure, the numeral 136 indicates a boiler input demand BID. The demand is determined by a boiler following type control method (refer to FIG. 8) or a turbine following type control method (refer to FIG. 9). In both control methods, as shown in FIGS. 8 and 9, the demand 136 is obtained by adding a correction amount from a main steam pressure controller to a power output demand 103 (MWD) obtained by a demand 101 sent from a central load dispatching station 100. If the boiler input demand BID is determined, a main steam temperature setting value corresponding to the BID is determined by a main steam temperature setting device 150. Then, the main steam setting value is compared with a detected main steam temperature 704 by a comparing circuit 152, and a main steam temperature deviation 153 is obtained. For the deviation, a control calculation such as a proportional integral is executed by a main steam temperature controller 154, and a fuel flow correction value 156 is obtained. And, an advanced command 160 of the fuel flow is obtained by a function generator 158 by inputting the boiler input demand BID to the function generator. The advanced command 160 of the fuel flow and the fuel flow correction value 156 are added together by a correcting device 162, and the addition result is used as a superheater fuel flow demand 164. Then, the difference between the demand 164 and a detected fuel flow 708 for the superheater is obtained by a subtracter 166 as a fuel flow deviation 168, and, for the deviation, a control calculation such as a proportional integral is executed by a fuel flow controller 170 for the superheater to make an operation signal 504 for controlling the fuel feed pump CWP-A for the superheater.

As for the reheated steam temperature control unit, almost the same control as explained above for the main steam temperature control unit is carried out. That is, a reheated steam temperature setting value is determined by a setting device 180 using the boiler input demand BID, and the setting value is compared with a detected reheated steam temperature 706 for obtaining a reheated steam temperature deviation 183. Then, for the obtained temperature deviation, a control calculation such as a proportional integral is executed by a reheated steam temperature controller 184 to obtain a fuel flow correction value 186. On the other hand, an advanced command 190 of the fuel flow is obtained by a function generator 188 by inputting the boiler input demand BID to the function generator. And, the advanced command 190 of the fuel flow and the fuel flow correction value 188 are added together by a correcting device 192 to produce a fuel flow demand 194 for the reheater. Then, the difference between the demand 194 and a detected fuel flow 710 are obtained by a subtracter 196 to provide a fuel flow deviation 196. For the fuel flow deviation 196, a control calculation such as a proportional integral is carried out, and an operation signal 506 for controlling the fuel feed pump CWP-B is obtained.

AS mentioned above, the main feature of the present invention is to provide a control apparatus which is able to control the fuel flow corresponding to the main steam temperature and the fuel flow corresponding to the reheated steam temperature, respectively. Such a control apparatus can be realized by the new fluidized bed power plant according to the present invention, in contrast to the conventional plant. That is, in the new constitution, more than two fluidized bed boilers are provided, and both the steam control of the main steam temperature and the reheated steam temperature is carried out independently for each corresponding fluidized bed boiler.

By constituting the fluidized bed power plant as explained above, it is possible to control separately the temperature of the main steam fed to the high pressure turbine and the temperature of the reheated steam fed to the intermediate or low pressure turbine, corresponding to the driving conditions of each one of the turbines.

Further, it is possible to improve the load following performance of the power plant without rapidly changing the bed temperature, by controlling the steam temperature of each boiler by adjusting the fuel flow for each boiler.

Figure 2:
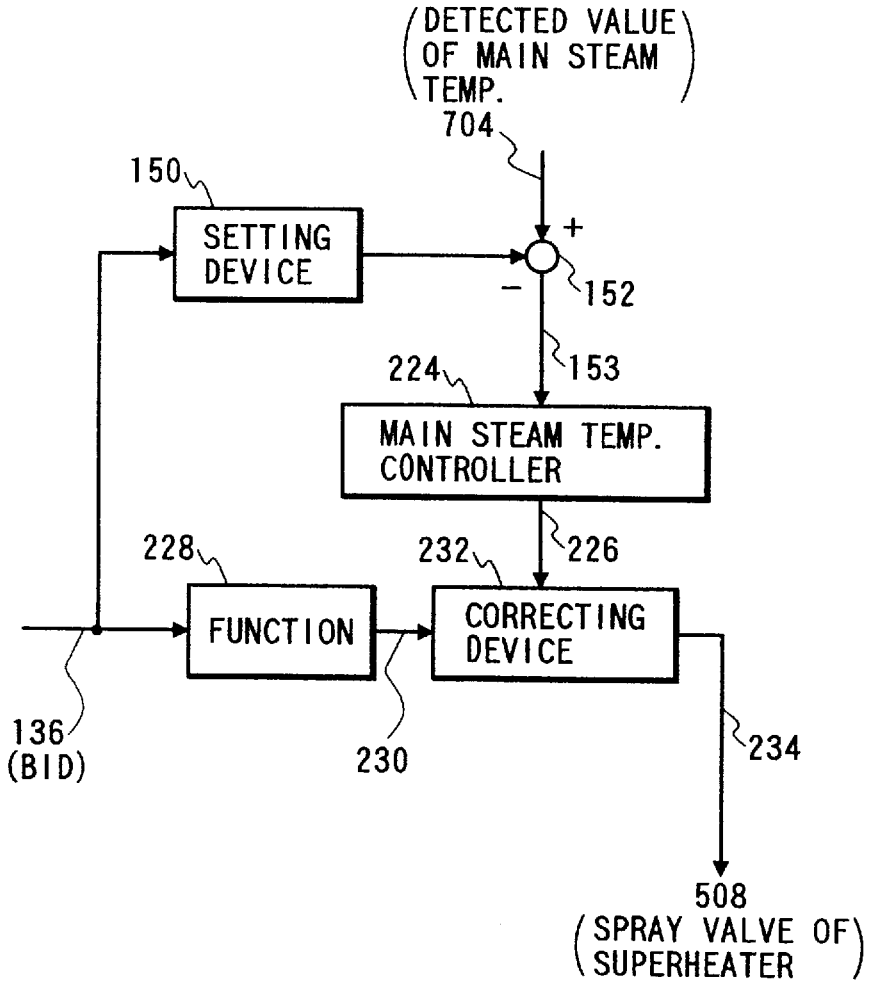
FIG. 2 is a schematic diagram of an example of a main steam temperature control unit of the embodiment.

FIG. 2 shows an example of a main steam temperature control unit according to this embodiment. The same reference numeral used in FIG. 2 as shown in FIG. 1 indicates the same or an equivalent component or circuit.

Although the main steam temperature is basically controlled by changing the fuel flow, as shown in FIG. 1, using a spray control and the fuel flow control together brings about a large steam control effect, since the spray control produces a quick response and effect. The spray control unit is composed as follows. That is, the main steam temperature setting value is obtained by the setting device, and the difference between the setting value and the detected main steam temperature 704 is calculated by the comparing circuit 152. Then, the steam temperature deviation 153 is obtained. Those steps are the same as those shown in FIG. 1. A main steam temperature controller 224 executes a proportional control on the steam temperature deviation and outputs a correction value 226 of a spray flow. An integral control is not used in the controller 224. If an integral control is used, it should be carefully applied, since an integral control can cause interference with the control of the fuel flow. Then, a function generator 228 determines an advanced value 230 of the spray flow. The advanced value 230 is added to the correction value 226 by a correcting device 232, and the addition result is used as an operation signal 234 to a superheater spray valve 508.

Figure 3:
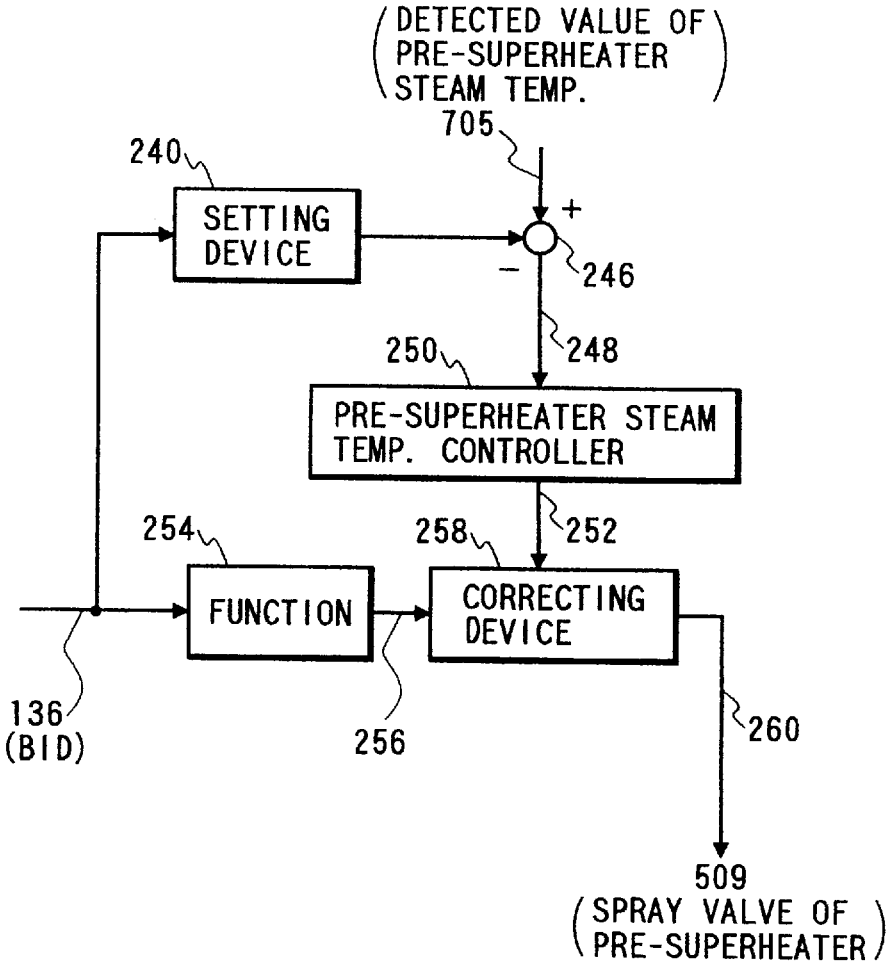
FIG. 3 is a schematic diagram of an example of a control unit for controlling the steam temperature of a pre-superheater provided in the fluidized bed power plant.

FIG. 3 shows an example of a control unit for controlling the steam temperature of a pre-superheater provided in the fluidized bed power plant. Although the spray control has a quick control effect, largely changing the spray flow is to be avoided since it causes a local dampness problem. Then, usually, spray control apparatuses for producing a plurality of sprays in steps are provided. The fundamental control method of the spray control apparatuses is the same as that of the spray control apparatus for controlling the main steam temperature shown in FIG. 2. Therefore, details of the control method of controlling the sprays for the presuperheater will be omitted.

Referring to FIGS. 4–7, another example of a control apparatus for a fluidized bed power plant are explained in the following.

In existing control methods, the fuel flow is regulated for controlling the bed temperature. Since the bed temperature is largely affected by the fuel flow, the stability of the bed temperature control by the fuel flow is excellent. However, in accordance with the present invention, since the fuel flow is used for controlling the main steam temperature and the reheated steam temperature, the bed temperature needs to be controlled by another manipulated quantity. Thus, one control method presented by the present invention is a two step cascade control method in which a bed temperature control and a bed height control are serially connected, by using the bed medium as the other manipulated quantity, as shown in FIG. 4.

Figure 4:
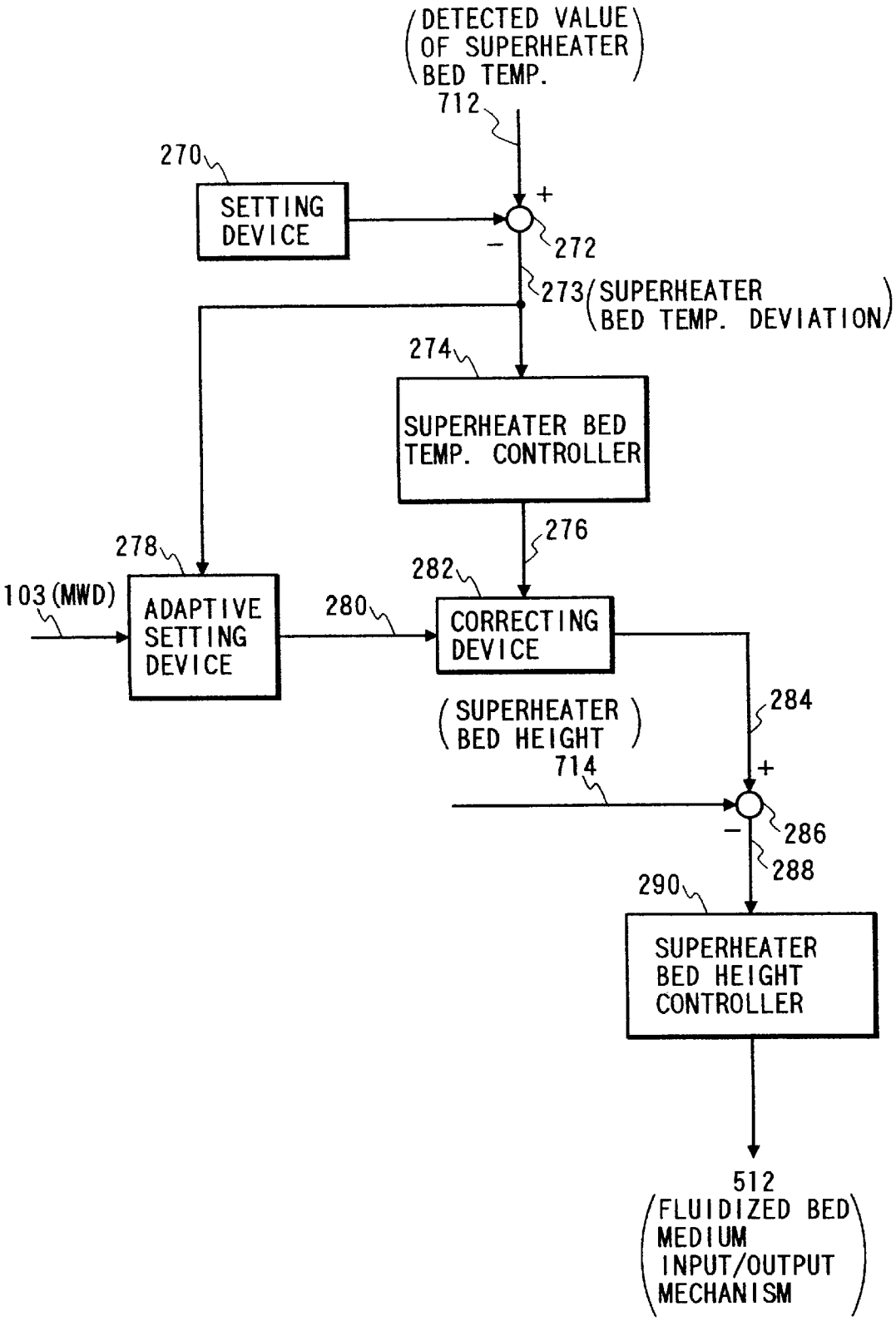
FIG. 4 is a schematic diagram of an example of a bed temperature control unit of a fluidized bed boiler provided in the power plant, which is used as a superheater.
Figure 6:
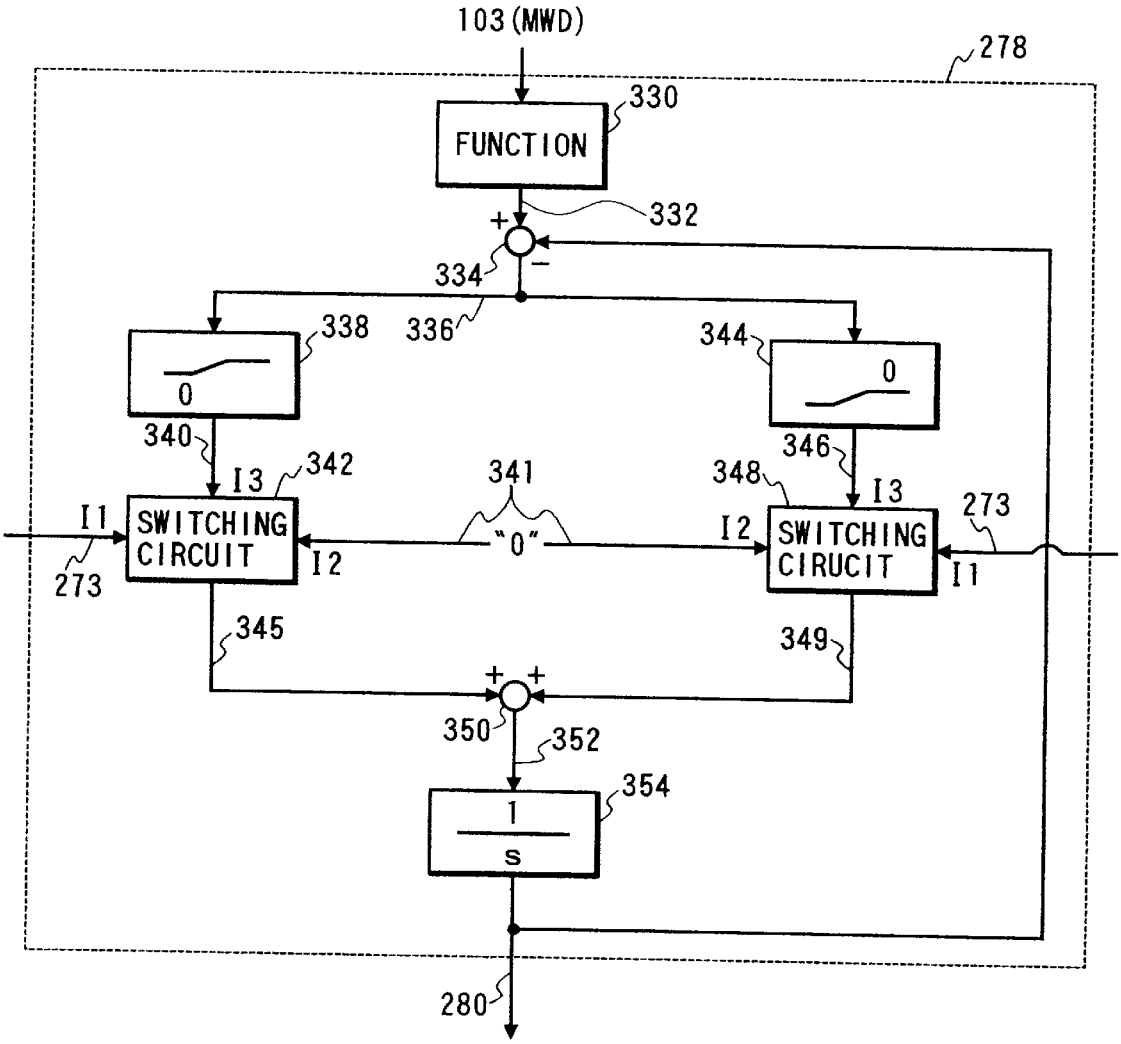
FIG. 6 is a schematic diagram of a detailed composition of the adaptive setting device 278 shown in FIG. 4.

FIG. 4 shows an example of a bed temperature control unit of a fluidized bed boiler provided in the power plant, which is used a superheater. In the figure, the bed temperature setting value is set to about 800° C.–900° C. from the point of view of the desulfurization performance and the ash fusion prevention. The difference between the bed temperature setting value and a detected superheater bed temperature 712 is calculated by a comparing circuit 272 to obtain a bed temperature deviation 273. To the bed temperature deviation, a proportional integral control calculation is executed by a superheater bed temperature controller 274, and a correction signal 276 of the bed temperature setting value is obtained. An adaptive setting device 278 receives the power output demand MWD 103 and a superheater bed temperature deviation 273, and determines a bed height setting value 280. The bed height setting value 280 is corrected with the correction signal 276, and a final bed height setting value 284 is obtained. A height deviation between a detected superheater bed height 714 and the setting value 284 is obtained by a subtracter 286 and input to a superheater bed height controller 290. The superheater bed height controller 290 determines the manipulated quantity for controlling the bed height, that is, a bed medium amount fed to the fluidized bed boiler or the bed medium extracted from the bed of the fluidized bed boiler, and the determined manipulated quantity signal is output to a fluidized bed medium input/output mechanism 512. Then, in a pressurized fluidized bed boiler, since the bed height is changed corresponding to its load, the bed height setting value is determined in accordance with the power output demand MWD 103 as mentioned above. In a usual method of setting the bed height, the bed height setting value is uniquely determined as a value of a function of the power output demand, namely, f(MWD). However, the method of the present invention does not uniquely determine the bed height setting value in accordance with the power output demand, but adequately changes the setting value in accordance with both the power output demand and the bed temperature deviation 273 by using the adaptive setting device 278, as shown in FIG. 6. And, the bed height is controlled by the bed medium (for example, limestone, gravel, etc.) flow. However, if the bed medium flow is controlled only in accordance with the load changes by the usual method, it causes a problem in that the bed temperature anomalously decreases and the desulfurization performance is also remarkably deteriorated, since the temperature (about 150° C.–200° C.) of the bed medium is lower than the bed temperature. Therefore, the bed height setting method effected by the adaptive setting device 278 as shown in FIG. 6 is employed by the present invention.

FIG. 6 is a diagram for explaining the adaptive setting device 278 in more detail. In the figure, a function generator 330 uniquely determines a bed height setting value 332 corresponding to the power output demand MWD 103. Then, in the setting device 278, the change of the bed height setting value 332 in the direction of increasing the bed height is restricted by a height change rate limiting circuit 338, and further the change of the setting value 332 is stopped by setting an input signal to an integral circuit 354 to zero in case the bed temperature exceeds a predetermined value using a switching circuit 342. The switching circuit 342 selects an input I3, namely, an output 340 in case the bed temperature deviation 273 is less than the predetermined value, and selects an input I2, namely "0", in case the deviation 73 exceeds the predetermined value. On the other hand, in the direction of decreasing the bed height, the bed height setting value 332 is restricted by a change rate limiting circuit 344, and a switching circuit 348 stops the change of the setting value 332 in case the absolute value of the negative bed temperature deviation 273 abnormally increases. The output signals 345 and 349 as explained above are added together by an adder 350 to provide an input signal 352 to an integrator 354. Then, the above-mentioned predetermined values are set to, for example, about ±10° C., respectively, on the basis of the permissible temperature deviation of about 8° C. as to the main steam and reheated steam.

As explained above, since the bed height setting value 280 is kept at the previous value by setting an input signal 352 to the integrator 354 to "0". In case the bed temperature deviation 273 exceeds the predetermined range of about ±10° C., it is controlled and suppressed so that the fed or extracted amount of the bed medium largely increases corresponding to the change of the bed height setting value 280 following the change of the power output demand MWD 103. Therefore, even during control of the feeding back of the bed height, as shown in FIG. 4, the changes of the temperature of the fluidized bed can be suppressed within a small variation range. Further, the stress imposed on the high pressure turbine or the intermediate or low pressure turbine by a rapid change in the steam temperature can be reduced by keeping the bed temperature deviation within a range near the permissible temperature deviation range of the turbine.

Then, in the above-mentioned control method, since the bed temperature can be controlled by changing the bed height, as opposed to the existing control method of controlling the bed temperature only by changing the fuel flow, it becomes possible to use the fuel flow as the manipulated quantity for controlling the steam pressure.

Figure 5:
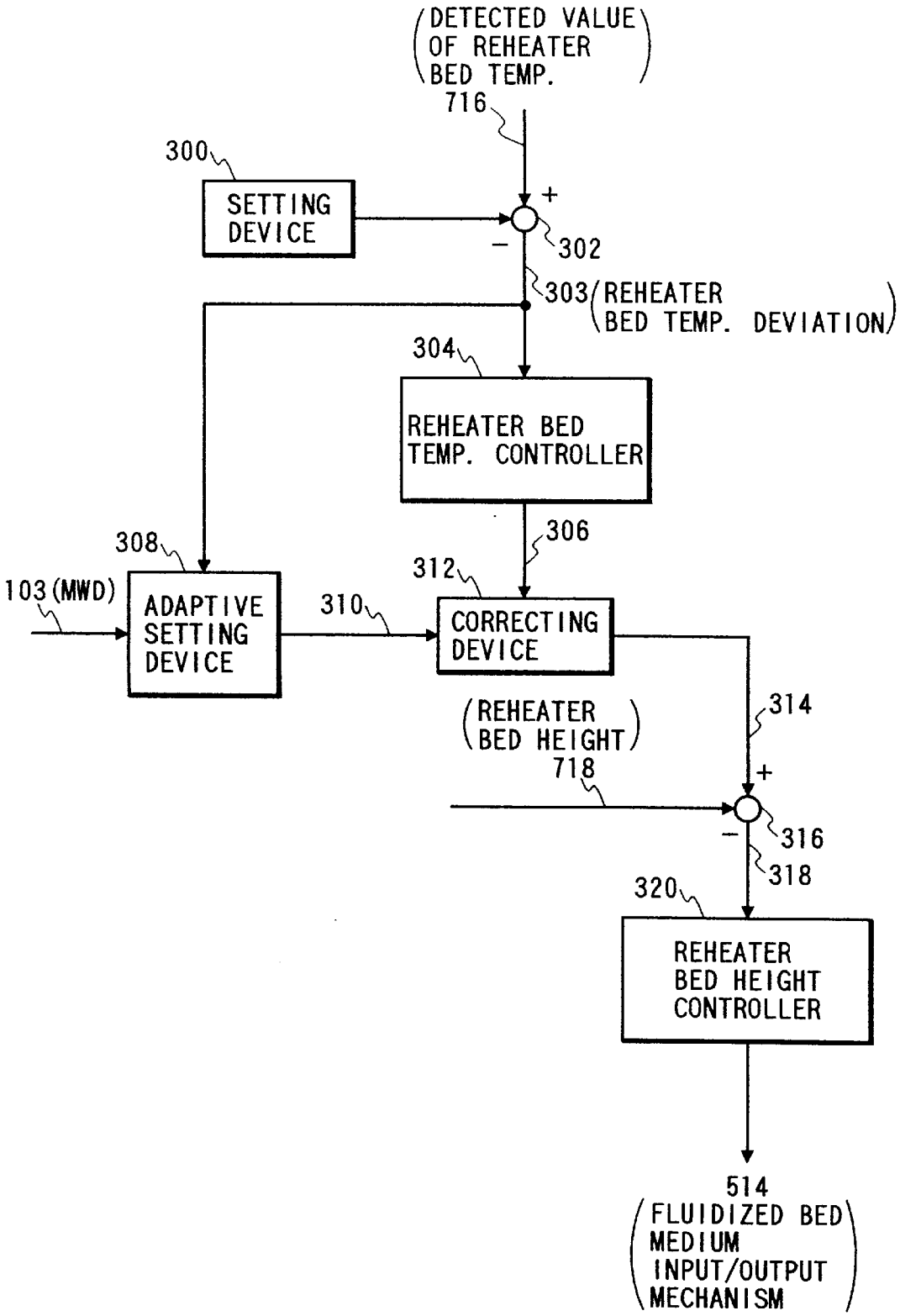
FIG. 5 is a schematic diagram of an example of a bed temperature control unit of a fluidized bed boiler provided in the power plant, which is used as a reheater.

FIG. 5 shows an example of a bed temperature control unit of a fluidized bed boiler provided in the power plant, which is used as a reheater, of which the main composition is the same as the one shown in FIG. 4. The only difference is that the control unit shown in FIG. 5 uses the detected values of a bed temperature and a bed height in the fluidized bed boiler of the reheater. Thus, a detailed explanation of this control unit will be omitted.

Figure 7:
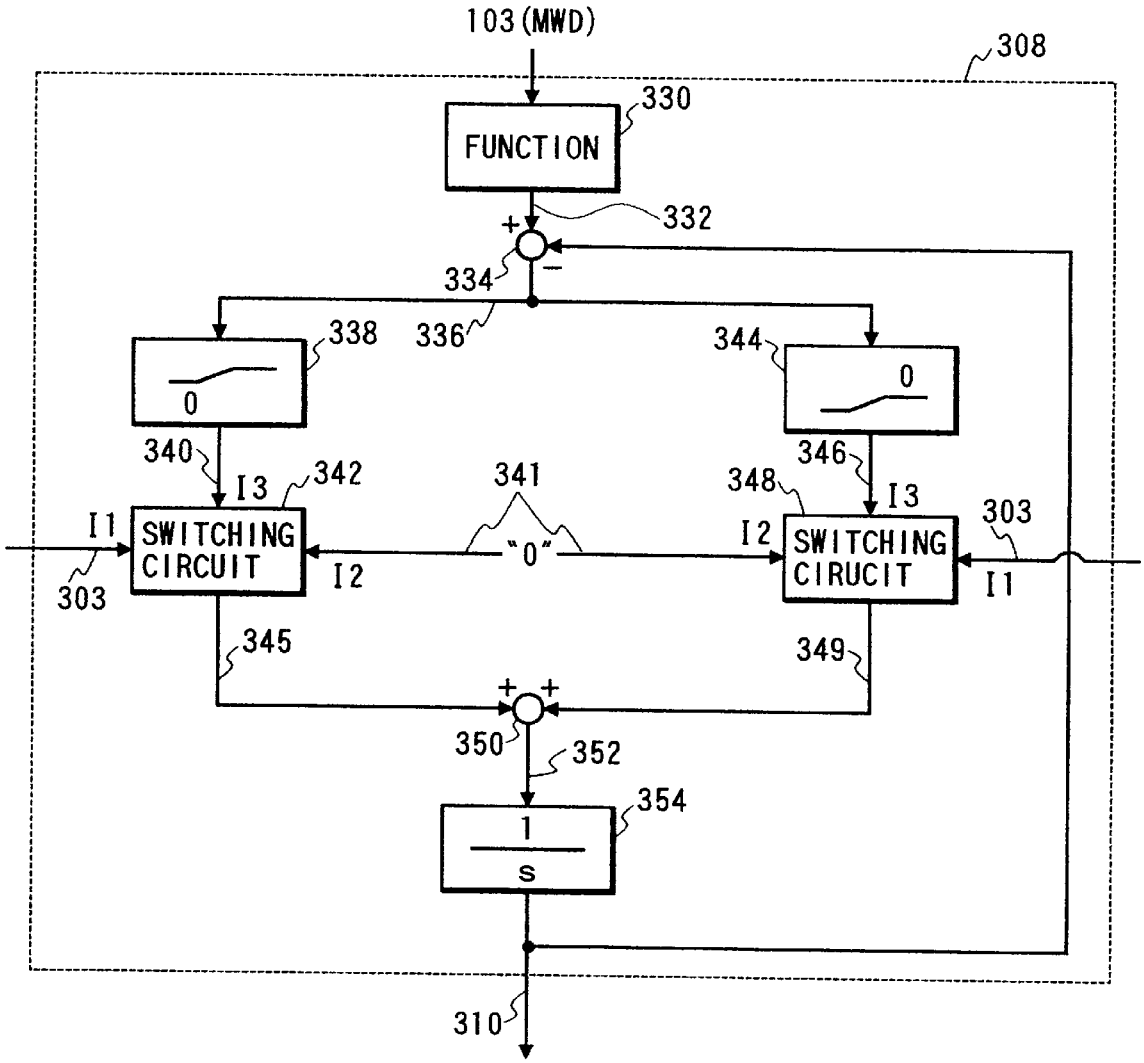
FIG. 7 is a schematic diagram of a detailed composition of the adaptive setting device 308 shown in FIG. 5.

FIG. 7 is a diagram for explaining the adaptive setting device 308 shown in FIG. 5 in more detail. Since the main composition is the same as the one shown in FIG. 6, a detailed explanation of this device will be omitted.

The above-explained control methods are, of course, applicable to either a fluidized bed boiler of the type used for a superheater or a fluidized bed boiler of the type used for a reheater, or both, and further they are applicable to a fluidized bed boiler having a structure capable of superheating and reheating the steam flowing in the boiler.

In the following, another embodiment of a fluidized bed boiler will be explained.

FIG. 8 shows a control unit using a boiler following method for a fluidized bed boiler. The control method used for this control unit is the same as the one applied to a powdered coal boiler or a raw petroleum boiler. The feature of the control method is to control the sum 700 of a steam turbine output and a gas turbine output by adjusting a turbine control valve 500 for controlling the steam pressure 702 by adjusting the feed water flow. Then, since the output power is controlled by the turbine control valve, quick load following operations are possible. In an existing control method, since the fuel flow is used for controlling the fluidized bed temperature and the bed temperature control has a slow response, the temperature changes of the steam temperature due to opening/closing of the turbine control valve can not be suppressed, and the boiler following type control is hardly applicable. On the other hand, in the present embodiment, since the fuel flow can be used to control the main steam temperature and the reheated steam temperature, the boiler following type control method is applicable. And, a turbine following type control method as shown in FIG. 9 is also applicable. The turbine following type control method is not appropriate for quick load following operations, but is adequate for a power plant for which the load following operation is not demanded.

Figure 10:
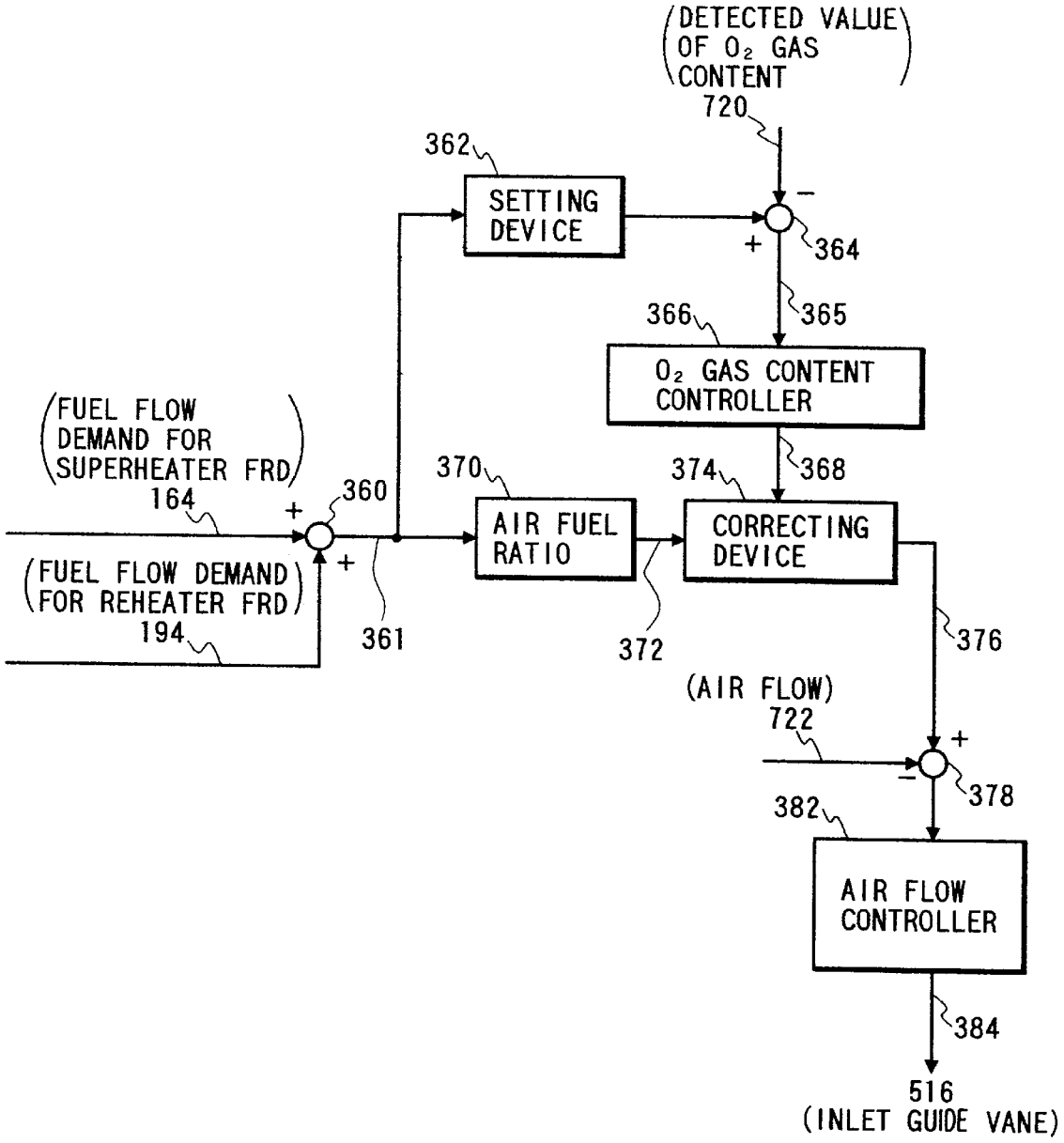
FIG. 10 is a schematic diagram of an example of an air flow control unit of the type used in the various embodiments.

FIG. 10 shows an example of an air flow control unit. In the figure, the numeral 164 indicates a fuel flow demand for the superheater, and the numeral 194 indicates a fuel flow demand for the reheater. Those demands are determined so as to control the bed temperatures of the superheater and the reheater to maintain predetermined values, respectively. An operating terminal of the air flow is not provided at each fluidized boiler. And, since the $O_2$ gas content to be detected for checking whether or not the air fuel ratio is adequate is not measured for each fluidized boiler, the $O_2$ gas content is detected downstream of the gas turbine. Therefore, the fuel flow demands 164 and 194 for the two fluidized bed boilers are summed by an adder 360 and the summation is used as a fuel flow demand 361 of an air flow control. Then, the fuel flow demand 361 is input to a setting device using a function generator 362, and the $O_2$ gas content setting value 362 is determined. And, the $O_2$ gas content setting value 362 is compared with a detected $O_2$ gas content, and an $O_2$ gas content deviation 365 is obtained by a comparing circuit 364. To the $O_2$ gas content deviation 365, a control calculation, such as a proportional integral calculation, is carried out by an $O_2$ gas content controller 366. Then, the advanced air flow demand 372 is determined by a correcting device, on the basis of the fuel flow demand 361, and a correction signal 368 is added to the determined advanced air flow demand to produce an air flow demand 376. Then, after the air flow demand 376 is determined, a difference calculation and a proportional integral calculation are executed by a comparing circuit 378 and a air flow controller 382, respectively. Further, using the output 384 of the air flow controller 382, an inlet guide vane 516 provided at a prestage of the gas turbine compressor COMP is operated.

Figure 11:
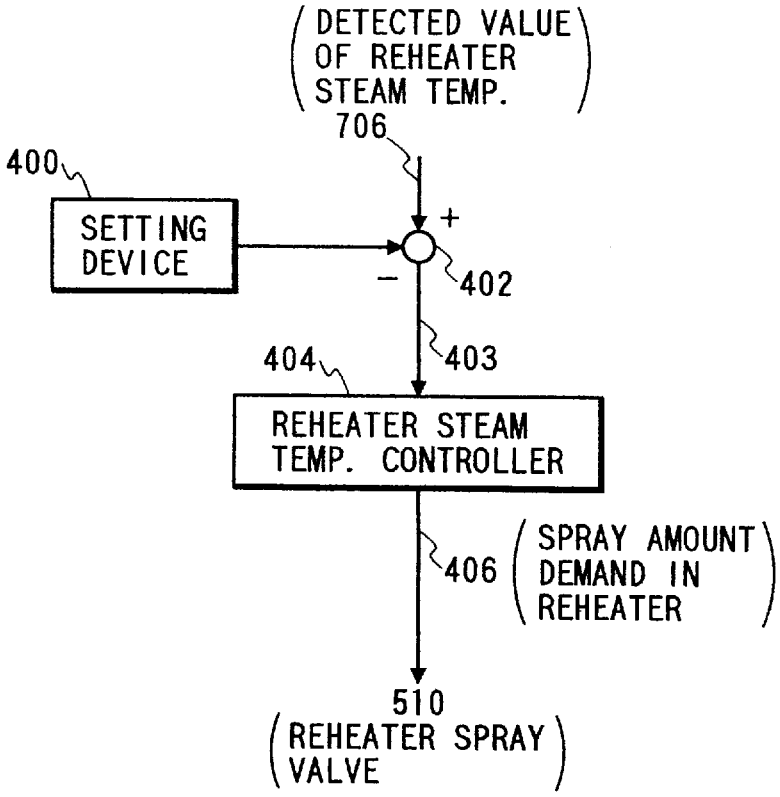
FIG. 11 is a schematic diagram of an example of a spray control unit for controlling reheated steam temperature.

FIG. 11 shows an example of a spray control unit used to assist the controlling of the reheated steam. For the reheater, since a large spray amount causes deterioration of plant efficiency, it is desirable to keep the spray amount zero usually. Therefore, a control circuit for keeping a constant spray amount in the load demand operations is removed in the embodiment. Then, in the embodiment, if the detected steam temperature 706 exceeds a predetermined value, the reheater steam temperature controller 404 operates and controls the reheated steam temperature within the prescribed temperature range.

In accordance with the present invention, since at least two fluidized bed boilers are separately installed to generate the main steam and the reheated steam, respectively, and the generated steam in each boiler is controlled by changing the fuel flow for each boiler, each of the temperature of the main steam to the high pressure turbine and the temperature of the reheated intermediate or low pressure turbine can be respectively controlled. Then, each steam temperature can be rapidly controlled corresponding to the load demand changes without producing rapid changes in the steam temperature during controlling of the steam temperature.

What is claimed is:

1. A fluidized bed power plant, comprising:

a first fluidized bed boiler for forming a first fluidized bed including fuel and a fluidized bed medium, burning fuel, and generating steam;

a first steam turbine driven by the steam generated by said first fluidized bed boiler;

a second fluidized bed boiler for forming a second fluidized bed including fuel and a fluidized bed medium, burning fuel, and heating the steam which has driven said first steam turbine;

a second steam turbine driven by the steam heated by said second fluidized bed boiler;

a first fluidized bed steam temperature control apparatus for controlling fuel flow fed to said first fluidized bed in accordance with a signal of a detected temperature of the steam generated in said first fluidized bed boiler and fed to said first steam turbine;

a first fluidized bed temperature control apparatus for controlling a height of a fluidized layer formed in said first fluidized bed in accordance with a signal of a detected temperature of said fluidized layer formed in said first fluidized bed boiler;

a second fluidized bed steam temperature control apparatus for controlling fuel flow fed to said second fluidized bed in accordance with a signal of detected temperature of the steam generated in said second fluidized bed boiler and fed to said second steam turbine; and a second fluidized bed temperature control apparatus for controlling a height of a fluidized layer formed in said second fluidized bed in accordance with a signal of detected temperature of said fluidized layer formed in said second fluidized bed boiler.

2. A fluidized bed power plant according to claim 1, wherein said second steam turbine is driven by steam of lower pressure than the steam which drives said first steam turbine, and a rotating axis of said second steam turbine is engaged with a rotating axis of said first steam turbine.

3. A fluidized bed power plant, comprising:

a first fluidized bed boiler for forming a first fluidized bed including fuel and a fluidized bed medium, burning fuel, and generating steam;

a first steam turbine driven by the steam generated by said first fluidized bed boiler;

a second fluidized bed boiler for forming a second fluidized bed including fuel and a fluidized bed medium, burning fuel, and heating the steam which has driven said first steam turbine;

a second steam turbine driven by the steam heated by said second fluidized bed boiler;

first fuel feeding means for feeding fuel to said first fluidized bed boiler;

first fluidized bed medium supplying and retrieving means for supplying the fluidized bed medium to said first fluidized bed boiler and retrieving the fluidized bed medium from said first fluidized bed boiler;

second fuel feeding means for feeding fuel to said second fluidized bed boiler;

second fluidized bed medium supplying and retrieving means for supplying the fluidized bed medium to said second fluidized bed boiler and retrieving the fluidized bed medium from said second fluidized bed boiler;

first steam temperature controlling means for controlling the temperature of the steam generated by said first fluidized bed boiler by controlling the flow of fuel fed by said first fuel feeding means in accordance with a detected temperature of the steam generated by said first fluidized bed boiler and fed to said first steam turbine;

first fluidized bed medium control means for controlling said first fluidized bed medium supplying and retrieving means in accordance with a detected temperature of a fluidized layer in said first fluidized bed boiler;

second steam temperature controlling means for controlling the temperature of the steam generated by said second fluidized bed boiler by controlling the flow of fuel fed by said second fuel feeding means in accordance with a detected temperature of the steam generated by said second fluidized bed boiler and fed to said second steam turbine; and second fluidized bed medium control means for controlling said second fluidized bed medium supplying and retrieving means in accordance with a detected temperature of a fluidized layer in said second fluidized bed boiler.

4. A fluidized bed power plant, comprising:

a first fluidized bed boiler for forming a fluidized bed including fuel and a fluidized bed medium, burning fuel and generating steam;

a first steam turbine driven by the steam generated by said first fluidized bed boiler;

a second fluidized bed boiler for forming a fluidized bed including fuel and a fluidized bed medium, burning fuel, and heating the steam which has driven said first steam turbine;

a second steam turbine driven by the steam heated by said second fluidized bed boiler; and means for controlling fuel flow of said first fluidized bed boiler in accordance with temperature of the steam generated by said first fluidized bed boiler and fed to said first steam turbine, and for controlling fluidized bed medium flow fed to said first fluidized bed boiler in accordance with a signal of a detected temperature of a fluidized layer formed in said first fluidized bed boiler; and means for controlling fuel flow for said second fluidized bed boiler in accordance with temperature of the steam heated by said second fluidized bed boiler and fed to said second steam turbine, and for controlling fluidized bed medium flow fed to said second fluidized bed boiler in accordance with a signal of a detected temperature of a fluidized layer formed in said second fluidized bed boiler.

5. A method of controlling a fluidized bed power plant having a first fluidized bed boiler for generating steam, a first steam turbine driven by the steam generated by said first fluidized bed boiler, a second fluidized bed boiler for heating the steam which has driven said first steam turbine, and a second steam turbine driven by the steam heated by said second fluidized bed boiler, said method comprising the steps of:

controlling the temperature of main steam for driving a high pressure turbine of said first steam turbine by controlling a flow of fuel fed to said first fluidized bed boiler in accordance with a detected temperature of said main steam generated by said first fluidized bed boiler;

controlling the temperature of a fluidized layer formed in said first fluidized boiler by supplying and retrieving a fluidized medium to and from said first fluidized bed boiler in accordance with a detected temperature of said fluidized layer formed in said first fluidized bed boiler;

controlling the temperature of reheated steam, obtained by reheating said main steam which has driven said high pressure turbine, for driving a low pressure turbine of said second steam turbine by controlling the flow of fuel fed to said second fluidized bed boiler in accordance with a detected temperature of the reheated steam; and controlling the temperature of a fluidized layer formed in said second fluidized boiler by supplying and retrieving a fluidized medium to and from said second fluidized bed boiler in accordance with a detected temperature of said fluidized layer formed in said second fluidized bed boiler.

6. A control apparatus for a fluidized bed power plant containing at least one fluidized bed boiler in which fuel mixed with a fluidized medium forms a fluidized bed and is burned, and bed height control means for controlling the height of the bed in the fluidized bed boiler by feeding said fluidized bed medium into said fluidized bed boiler or extracting a part of a bed of said fluidized bed boiler, said control apparatus comprising:

temperature deviation calculating means for obtaining a temperature deviation between a detected temperature of said bed and a prescribed temperature value;

bed height setting value calculating means for obtaining a bed height setting value from a load demand command for said power plant;

means for obtaining a control signal based on a bed height deviation between a detected bed height and said bed height setting value obtained by said bed height setting value calculating means and for sending said control signal to said bed height control means; and means for keeping said bed height setting value obtained by said bed height setting value calculating means at a fixed value, when said temperature deviation value obtained by said temperature deviation calculating means exceeds a predetermined value.

* * * * *